US008602112B2

(12) United States Patent
Reid

(10) Patent No.: US 8,602,112 B2
(45) Date of Patent: Dec. 10, 2013

(54) CONTROL APPARATUS FOR DOWNHOLE VALVES

(75) Inventor: Michael Adam Reid, Aberdeen (GB)

(73) Assignee: Halliburton Manufacturing & Services Limited, Leatherhead (GB)

( * ) Notice: Subject to any disclaimer, the term of this patent is extended or adjusted under 35 U.S.C. 154(b) by 87 days.

(21) Appl. No.: 13/296,741

(22) Filed: Nov. 15, 2011

(65) Prior Publication Data

US 2012/0125628 A1 May 24, 2012

(51) Int. Cl.
*E21B 34/10* (2006.01)

(52) U.S. Cl.
USPC ..... 166/375; 166/319; 166/373

(58) Field of Classification Search
USPC ..... 166/373, 374, 375, 319, 331, 72
See application file for complete search history.

(56) References Cited

U.S. PATENT DOCUMENTS 5,875,852 A 3/1999 Floyd et al.
6,575,237 B2 * 6/2003 Purkis et al. ..... 166/72
2002/0066574 A1 * 6/2002 Leismer et al. ..... 166/375
2007/0102163 A1 * 5/2007 Heath et al. ..... 166/386
2007/0187106 A1 8/2007 Wolters

FOREIGN PATENT DOCUMENTS

GB 2 411 677 A 9/2005
GB 2 434 814 A 8/2007

OTHER PUBLICATIONS

UK Search Report: Appln. GB1019746.5; Date of Search: Jan. 28, 2011.

* cited by examiner

*Primary Examiner* — Kenneth L Thompson
*Assistant Examiner* — Taras P Bemko
(74) *Attorney, Agent, or Firm* — Scott Wendorf; Fish & Richardson P.C.

(57) ABSTRACT

There is herein defined a control apparatus operable to control the opening and closing of downhole flow control devices. The apparatus includes first and second indexing modules, which are arranged in fluid communication with a respective downhole control device. Each of the modules includes two inlet ports and two outlet ports, where the inlet ports are each in fluid communication with one of two control lines. The first module is operable to open and close a first downhole control device on application of fluid pressure through the first control line and the second module is operable to open and close a second downhole control device on application of fluid pressure through the second control line.

25 Claims, 7 Drawing Sheets

CONTROL APPARATUS FOR DOWNHOLE VALVES

FIELD OF THE INVENTION

The present invention relates to a control apparatus and a method for controlling downhole flow control devices. More particularly, the present invention relates to a control apparatus capable of opening and closing a downhole flow control device and a method of opening and closing a downhole flow control device.

BACKGROUND OF THE INVENTION

It is well-known in the oil industry in the method of controlling downhole devices to use pressurised hydraulic fluid in a small diameter control line. The pressurised hydraulic fluid extends from a surface pump through the wellhead and connects to a downhole device such as a flow control valve(s). In the completion stage of well production it is generally required at some stage in the process that a production tubing string is closed off for testing. This allows, among other operations, for production packers to be set and tested.

Although a variety of processes and apparatus exist in the market for controlling valves, these prior art processes and apparatus are known to suffer from a number of disadvantages. For example, prior art processes and apparatus are known to be depth-dependent and therefore either their efficiency is reduced as depth is increased or they fail to work at depths commonly used in oil recovery. This can have a serious effect on the efficiency of oil production.

Generally, flow control valves are deployed as part of a tubing string with hydraulic control lines linked to the surface for remote activation. Remote activation of conventional double actuating flow control valves generally utilises two control lines, where one control line is used to open the valve and one control line is used to close the valve. Four control lines would be needed if two flow control valves were to be operated. In each case, one control line acts as the operational control line whereby fluid pressure is applied to the valve to cause the valve to open or close and the second control line for each operation of the valve acts as a return line. A double actuating control valve may be capable of being fully open to allow maximum flow through the valve, thereby maximising production or injection rates through the production string. This may also allow for easy access to the well and any equipment below the valve. In a fully closed position the valve is operable to close the flow path through the production string to allow testing of the tubing string to be carried out and to allow setting and testing of production packers etc.

Using a large number of hydraulic control lines leads to a complex apparatus which can easily break down. This is a major problem as this type of equipment is intended to be used in downhole completion operations hundreds of meters below the ground or sea-bed. Moreover, using a large number of hydraulic control lines increases the expense of the apparatus for potential users and increases the level of servicing required.

It is an object of at least one aspect of the present invention to obviate or mitigate at least one or more of the aforementioned problems.

It is a further object of at least one aspect of the present invention to provide an improved apparatus for controlling downhole flow control devices.

It is a further object of at least one aspect of the present invention to provide an improved method for controlling downhole flow control devices.

SUMMARY OF THE INVENTION

According to a first aspect of the present invention there is provided a control apparatus for a downhole flow control device, the apparatus being operable to control opening and closing of a downhole flow control device:

the apparatus comprising first and second modules, wherein each module is operable to fluidly connect with a respective downhole control device:

each module comprises two inlet ports and two outlet ports;

wherein one inlet port of each module is adapted to fluidly communicate with a first control line located above and the other inlet port of each module is adapted to fluidly communicate with a second control line located above;

the first module being operable to open and close a first downhole control device on application of fluid pressure through the first control line; and the second module being operable to open and close a second downhole control device on application of fluid pressure through the second control line;

wherein each module comprises a switching member defining a fluid flow path and under application of fluid pressure from the first or second control line the switching member is operable to direct fluid pressure to one of the two outlets to activate opening or closing the first or second downhole flow control device.

The present invention therefore relates to a control apparatus capable of opening and closing a downhole flow control device and a method of opening and closing a downhole flow control device.

The control apparatus may be used in downhole well completion applications such as onshore and offshore oil recovery. The first and second modules may advantageously facilitate independent remote activation of two flow control devices using only two control lines from surface.

The first control line may be an operational control line for activating a first flow control device and the second control line may act as a return line for the first flow control device. Similarly, the second control line may be an operational control line for activating a second flow control device and the first control line may act as a return line for the second flow control device.

The return line provided by the first control line may be adapted to provide feedback indicating activation of the second flow control device. Similarly, the return line provided by the second control line may be adapted to provide feedback indicating activation of the first flow control device.

Advantageously, the flow control devices may be operated independently of each other and may therefore independently open and close an associated flow control device. The operation of each flow control device may therefore be dependent only on which of the two control lines provides fluid pressure to the flow control devices via the associated module. The first and second modules may therefore be operated independently.

Conventional systems require two control lines per flow control device or valve (for example, two flow control devices would require four control lines). The present invention may operate two flow control devices independently of each other using only two control lines. By reducing the complexity of the system to use only two control lines the time and cost of installing and also maintaining control lines may be reduced.

In addition, material handling and the cost of materials compared with conventional systems may also be reduced.

The control apparatus may operate on a closed loop hydraulic circuit, with the lines hydrostatically balancing each other. Therefore, deployment of the downhole valves does not need to be depth dependent as found in prior art systems. Fluid pressure applied via the operational control line may be returned via the other control line. Therefore, feedback may be provided to indicate if the flow control device has functioned correctly.

When the flow control device is fully open or fully closed unwanted actuation of the flow control device may be prevented due to the arrangement of the control apparatus, wherein activation of the flow control device from 'open to closed' or from 'closed to open' may only be initiated upon activation via the operational control line and the relevant module.

Activation of each flow control device may be controlled by a flow path through each of the modules, where the flow path may be defined by the switching member. The switching member may form part of an actuating piston or alternatively may be a separate component part.

The switching member may be adapted to rotate, twist and/or turn upon application of fluid pressure via the operational control line such that the flow path may be directed to the relevant output of the module and thereby actuate the flow control device. The flow path on the switching member may be defined by one or more directional channels.

The one or more directional channels defining the flow path may be arranged such that fluid entering the flow path is translated to an outlet only after the switching member rotates, turns, and/or twists to direct the applied fluid to the correct output port for actuation of the flow control device. Rotation, turning and/or twisting of the switching member may divert the flow path of the fluid towards the respective outlet.

Movement of the piston member may be limited to axial or substantially axial translation only. The piston may be prevented from rotation such that only the switching member rotates by a desired amount to ensure correct diversion of the flow path of the fluid towards the respective outlet. The piston member may comprise guiding means to minimize any rotation of the piston member during axial translation.

Axial translation of the piston member may cause rotation of the switching member. The piston member may comprise engaging means operable to engage with the switching member to cause rotation of the switching member. The engaging means may be a protruding component, such as a lug or key that may be adapted to engage with one or more guiding slots provided in the surface of the switching member. The engaging means may be arranged to move axially together with the piston member and to follow a path defined by the one or more slots on the switching member to cause rotation of the switching member. The one or more slots may include at least one angular section. The one or more slots may also include at least one axial section.

Axial translation of the piston member and the engaging means may convert to angular movement of the switching member to divert the fluid flow path towards a respective outlet.

The piston member may be biased in one direction, for example, by a compression spring. Under the application of fluid pressure from the operational control line the piston member may translate axially in one direction only. Axial translation of the piston member in one direction, opposite to the biased to direction, may be caused by application of hydraulic fluid pressure in the same direction as the desired axial translation. Return of the piston member to the biased to direction may occur on removal of the application of hydraulic fluid pressure.

Each module may comprise a unidirectional flow valve, for example a ball check valve, that may be adapted to be in fluid communication with the fluid flow path in fluid communication with the operational control line. The unidirectional valve may be adapted to prevent activation of the flow control device when fluid pressure is applied via the control line designated as a return line for the particular flow control device. Therefore, independent control of each flow control device may be ensured.

In particular embodiments, a first indexing module may comprise a first and second inlet port, and a first and second outlet port. The first inlet port may be in fluid communication with a first control line and the second inlet port may be in fluid communication with a second control line. The outlet ports may be in fluid communication with their respective flow control device such that when fluid pressure is applied via the respective control line and directed to the respective outlet then the respective flow control device may move to the open or closed position as is appropriate.

In particular embodiments, the axial translation or substantially axial translation of the piston member may be dependent on the level of fluid pressure applied. Physical activation of the switching member to rotate may also be dependent on the level of fluid pressure applied. Rotation of the switching member may divert the flow path to an associated flow control device. The control apparatus may also comprise a limiting mechanism adapted to limit travel of the piston member when the fluid pressure applied is within a first predetermined range of about 69 to 172 bar (about 1000 to 2500 PSI). The limiting mechanism may be operable to limit travel of the piston member if the applied fluid pressure is below or within a first predetermined range of about 69 to 172 bar (about 1000 to 2500 PSI). Rotation of the switching member may be prevented if the applied fluid pressure is below or within a first predetermined range of about 69 to 172 bar (about 1000 to 2500 PSI).

In particular embodiments, the switching member may be adapted to rotate in one direction upon application of fluid pressure via the operational control line and to rotate in an opposite direction on removal of applied pressure. The switching member may be biased in one orientation where the flow path through the device is arranged through a first outlet. Rotation of the switching member may be prevented when the applied pressure is within a first predetermined range of about 69 to 172 bar (about 1000 to 2500 PSI) such that fluid exits through the first outlet. Rotation of the switching member may divert the flow path of the fluid towards a second outlet only when the applied pressure is within a second predetermined range of about 205 to 345 bar (about 3000 to 5000 PSI). The second predetermined pressure range may be higher than the first predetermined range. The first predetermined pressure range may be about 69 to 172 bar (about 1000 to 2500 PSI). The second predetermined pressure range may be about 205 to 345 bar (about 3000 to 5000 PSI).

According to a second aspect of the present invention there is provided a method of opening and closing of a downhole flow control device using a control apparatus, the method comprising:

providing an apparatus comprising first and second modules, wherein each module is operable to fluidly connect with a respective downhole control device:

each module comprises two inlet ports and two outlet ports;

wherein one inlet port of each module is adapted to fluidly communicate with a first control line located above and the other inlet port of each module is adapted to fluidly communicate with a second control line located above;

the first module being operable to open and close a first downhole control device on application of fluid pressure through the first control line; and the second module being operable to open and close a second downhole control device on application of fluid pressure through the second control line;

wherein each module comprises a switching member defining a fluid flow path and under application of fluid pressure from the first or second control line the switching member is operable to direct fluid pressure to one of the two outlets to activate opening or closing the first or second downhole flow control device.

The method may therefore be used to open and close a downhole flow control device in a downhole well completion.

The control apparatus may be as defined in the first aspect.

According to a third aspect of the present invention there is provided a well bore comprising a control apparatus as defined in the first aspect.

BRIEF DESCRIPTION OF THE DRAWINGS

Embodiments of the present invention will now be described, by way of example only, with reference to the accompanying drawings, in which:

FIG. 2(*b*) is a schematic representation of a second indexing module capable of opening and closing a downhole flow control device according to an embodiment of the present invention;

FIG. 2(*c*) is a schematic partial view of a tubular production string according to an embodiment of the present invention comprising the first and second indexing modules shown in FIGS. 2(*a*) and 2(*b*);

FIG. 3(*b*) is a schematic sectional view of the indexing module shown in FIG. 3(*a*) where fluid pressure is applied through a first inlet port via a first control line;

FIG. 3(*c*) is a schematic sectional view of the indexing module shown in FIG. 3(*b*) representing an active flow path and a return flow path; and FIG. 3(*d*) is a schematic sectional view of the indexing module shown in FIG. 3(*a*) where fluid pressure is applied via a return control line.

FIG. 5(*b*) is a schematic sectional view of a first indexing module shown in FIG. 5(*a*) where fluid pressure is applied through a first inlet port via a first control line to close a first flow control device;

FIG. 5(*c*) is a schematic sectional view of a first indexing module shown in FIG. 5(*a*) where fluid pressure is applied through a first inlet port via a first control line to open a first flow control device;

FIG. 5(*d*) is a schematic sectional view of a first indexing module shown in FIG. 5(*a*) where fluid pressure is removed;

FIG. 5(*e*) is a schematic sectional view of the indexing module shown in FIG. 5(*a*) where fluid pressure is applied via a return control line.

BRIEF DESCRIPTION

Generally speaking, the present invention resides in the provision of a control apparatus capable of independently opening and closing two downhole flow control devices and a method of independently opening and closing two downhole flow control devices using only two control lines from surface.

Figure 1:
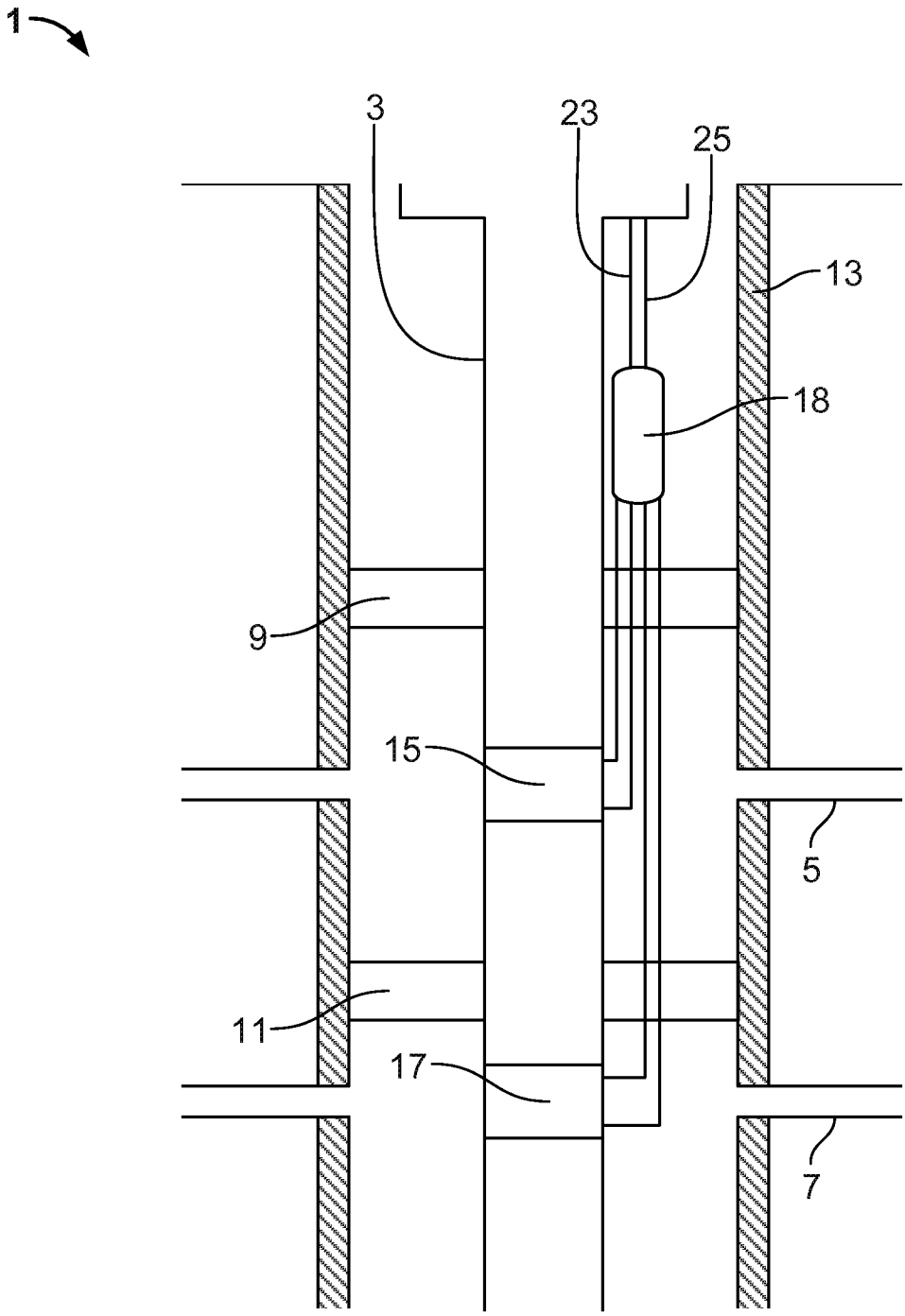
FIG. 1 is a schematic partial longitudinal sectional view of a wellbore comprising downhole components according to an embodiment of the present invention.

Referring to FIG. 1, there is shown a partial longitudinal sectional view of a completed well bore, generally designated 1. The completed well bore 1 includes a substantially tubular production string 3 that extends through particular production zones 5, 7. Packers 9, 11 are installed close to and above or substantially above the production zones 5, 7. Each packer 9, 11 is operable to isolate an annulus between the tubular string 3 and an inner casing 13 from further downhole in the well bore 1. The packers 9, 11 are operable to stop reservoir fluids from flowing up the full length of the inner casing 13.

Figure 2A:
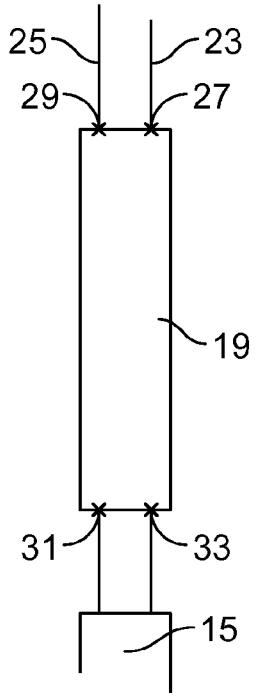
FIG. 2(*a*) is a schematic representation of a first indexing module capable of opening and closing a downhole flow control device according to an embodiment of the present invention.
Figure 2B:
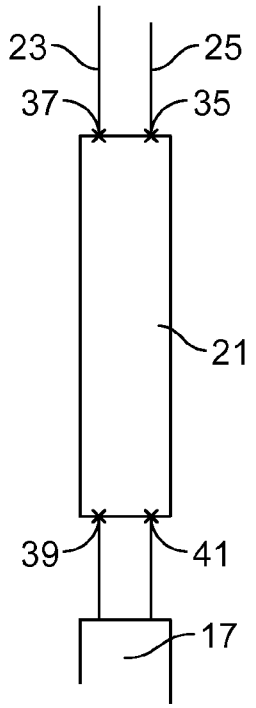
Figure 2C:
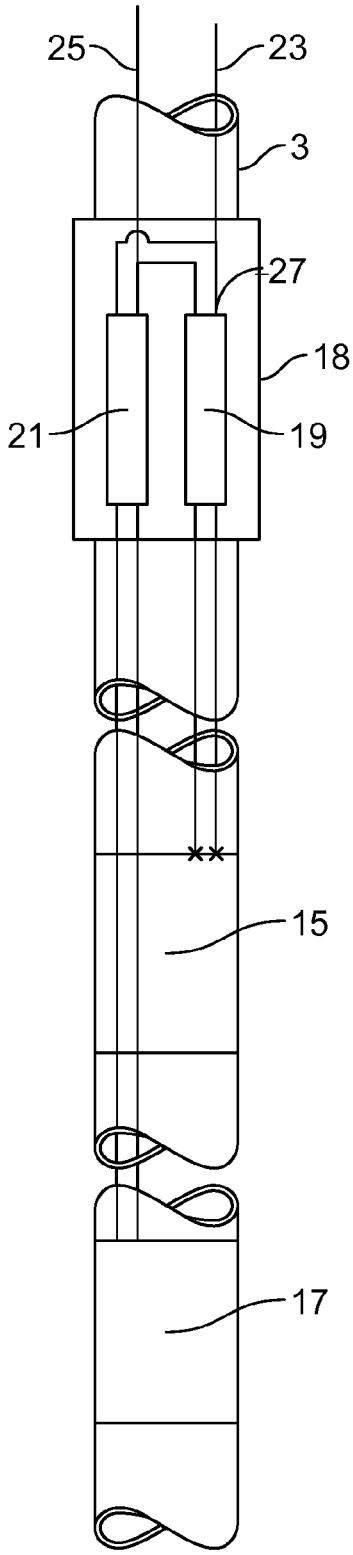
Figure 3A:
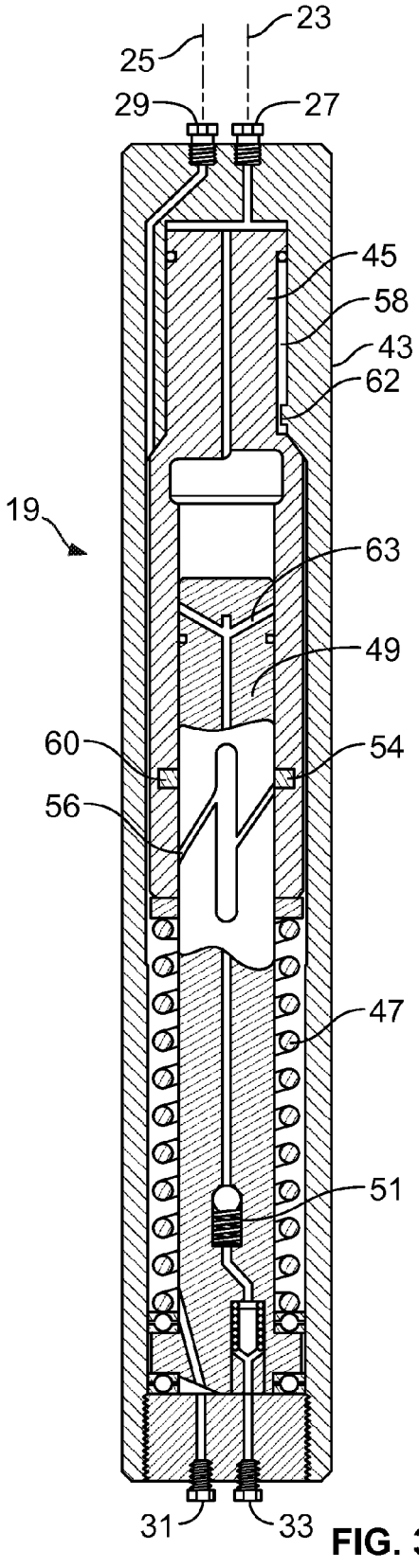
FIG. 3(*a*) is a schematic sectional view of an indexing module according to an embodiment of the present invention forming part of the control apparatus shown in FIGS. 2(*a*) and 2(*b*)
Figure 3B:
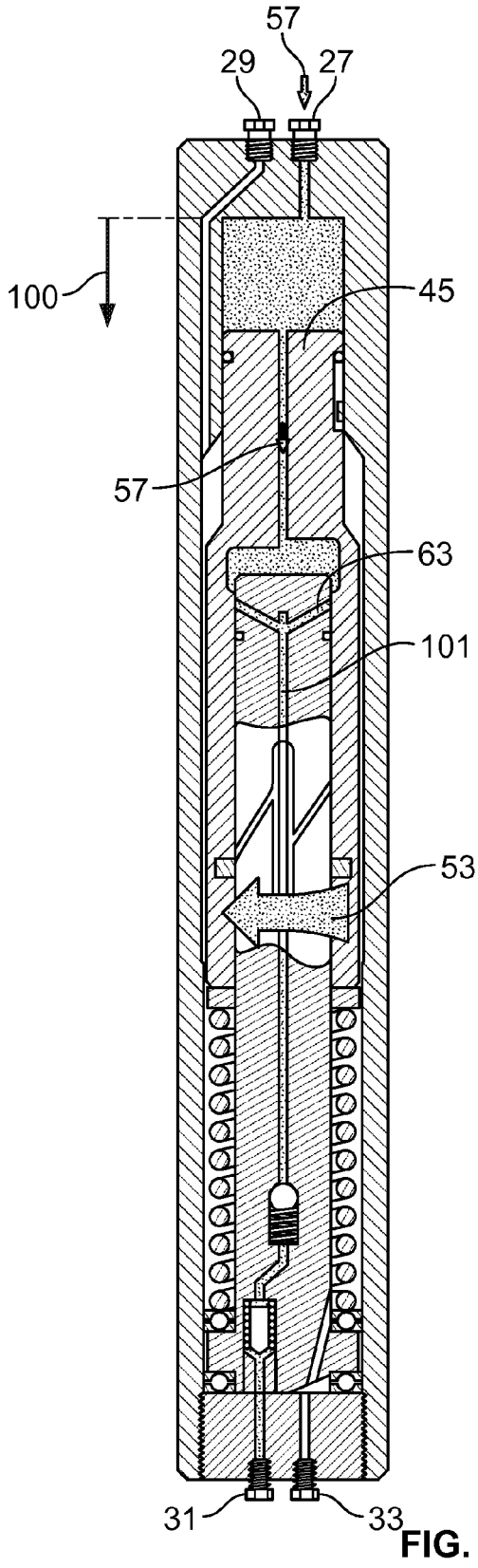
Figure 3C:
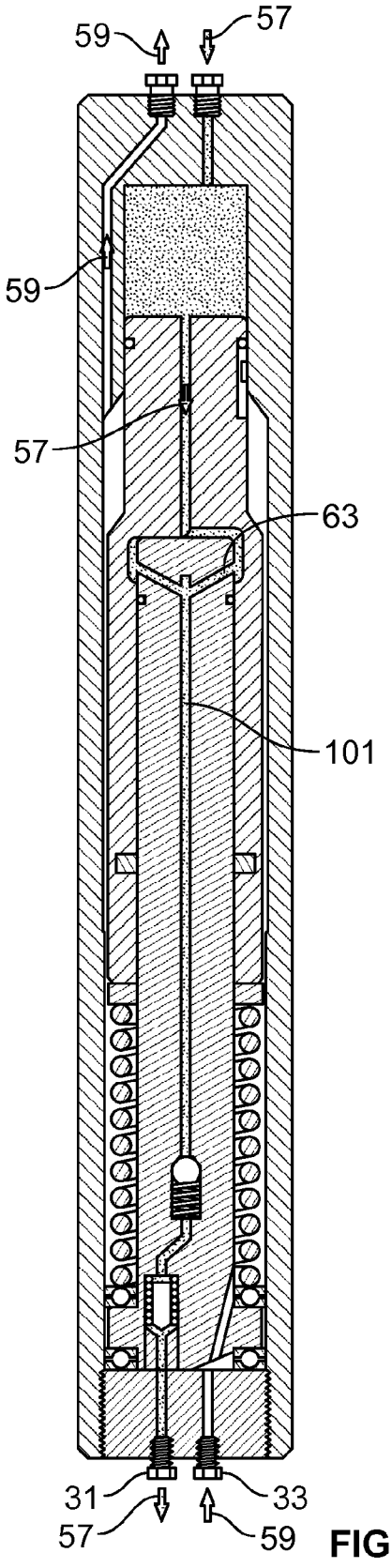
Figure 3D:
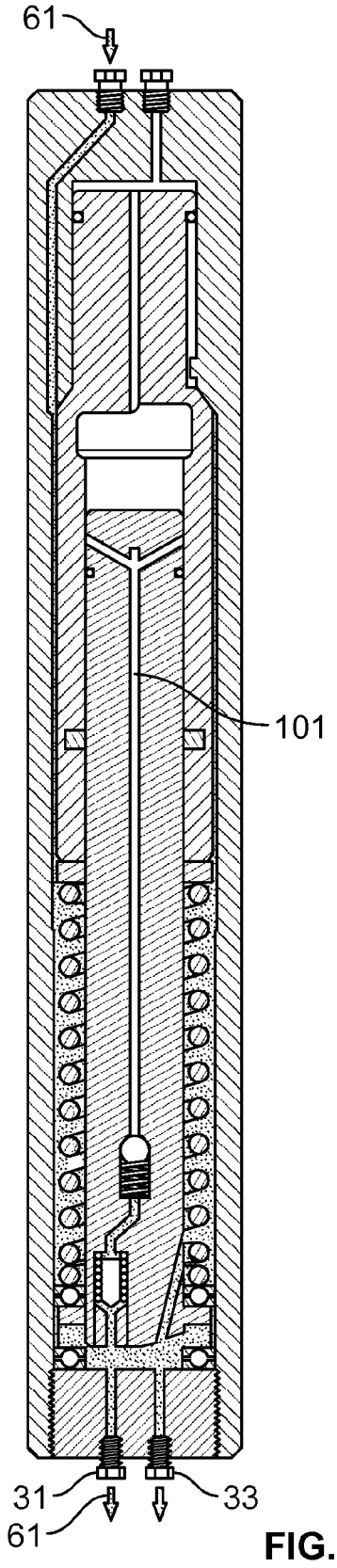

The tubular string 3 also includes flow control devices or valves 15, 17. The flow control devices or valves 15, 17 may be arranged to be opened or closed to allow or prevent flow through the tubular string 3. The flow control devices 15, 17 are each fluidly connected to an indexing carrier 18 comprising two indexing modules 19, 21 which are shown in FIGS. 2(*a*) and 2(*b*). The indexing carrier 18 is generally located above or substantially above the flow control devices 15, 17, with the indexing modules 19, 21 located on the outside of the carrier 18, in the annulus between the tubular string 3 and the casing 13. Two control lines 23, 25, located above or substantially above the indexing carrier 18, fluidly connect each of the indexing modules 19, 21 with an associated flow control device 15, 17.

The control lines 23, 25 are each operable to control independent opening and closing of an associated flow control device 15, 17 as described further below.

Referring to FIGS. 2(*a*), 2(*b*) and 2(*c*), there is shown a schematic layout of the arrangement of the tubular string 3, the flow control devices 15, 17, the indexing modules 19, 21 and the control lines 23, 25.

The first indexing module 19 shown in FIG. 2(*a*) comprises a first inlet port 27, a second inlet port 29, a first outlet port 31 and a second outlet port 33. The first inlet port 27 is in fluid communication with the first control line 23 and the second inlet port 29 is in fluid communication with the second control line 25. The outlet ports 31, 33 are arranged to be in fluid communication with the first flow control device 15 such that when fluid pressure is applied via the first control line 23 and directed to outlet 31 the flow control device 15 moves to the closed position. The outlet port 33 is arranged in fluid communication with the first flow control device 15 such that when fluid pressure is applied via the first control line 23 and directed to outlet 33 the flow control device 15 returns to the open position.

The second indexing module 21 shown in FIG. 2(*b*) operates in the same way as the first, but is arranged to be in fluid communication with the second control device 17. Accordingly, the second indexing module 21 comprises a first inlet port 35, a second inlet port 37, a first outlet port 39 and a second outlet port 41. The first inlet port 35 is in fluid communication with the second control line 25 and the second inlet port 37 is in fluid communication with the first control line 23. The outlet ports 39, 41 are arranged to be in fluid communication with the second flow control device 17 such that when fluid pressure is applied via the second control line 25 and directed to outlet 39 the flow control device 17 moves to the closed position. The outlet port 41 is arranged in fluid communication with the second flow control device 17 such that when fluid pressure is applied via the second control line 25 and directed to outlet 41 the flow control device 17 moves to the open position.

The detailed operation of the first and second indexing modules 19, 21, respectively, and the flow control devices 15, 17 will be described further below with reference to FIGS. 3(*a*), 3(*b*), 3(*c*) and 3(*d*).

An example of the first indexing module 19 and various stages of operation when fluid pressure is applied are illustrated in FIGS. 3(*a*), 3(*b*), 3(*c*) and 3(*d*).

Referring first to FIG. 3(*a*), the first indexing module 19 is illustrated in cross-section and represents the status of the system when no pressure is applied via either of the control lines 23, 25 (shown as phantom lines).

The first indexing module 19 comprises a tubular casing 43 in which there is provided a movable piston 45 which is biased in the position illustrated by, for example, a compression spring 47. A switching or toggle member 49 is shown in cross-section with a central portion illustrated in full in FIGS. 3(*a*) and 3(*b*) to illustrate the surface form of the toggle member 49, which is discussed in more detail below.

The first indexing module 19 also includes a unidirectional valve 51. In FIGS. 3(*a*) to 3(*d*) the unidirectional valve 51 is represented by a ball and spring arrangement (ball check valve) as an example of a suitable unidirectional valve and to illustrate how the flow path through the valve 51 is limited to flow in one direction only. The unidirectional valve 51 is operable to allow flow in the direction of the outlets 31, 33 only. It will be appreciated that any suitable non-return or unidirectional valve may be used.

In the illustrated embodiment, the toggle member 49 is operable to rotate, turn and/or twist about the axis of the piston 45 on application of fluid pressure from the operational control line 23, 25. The term operational control line relates to the control line that delivers fluid pressure to cause a flow control device 15, 17 to open or close. Therefore, the first control line 23 is the operational control line for the first indexing module 19 and the first flow control device 15 and the second control line 25 is the operational control line for the second indexing module 21 and the second flow control device 17.

In the illustrated embodiment, the toggle member 49 comprises a helical slot arrangement 56, known generally as a J-slot, formed in the surface of the toggle member 49. A key 54 is located in a keyway 60 on the piston 45. The operation of the key 54 relative to the slot 56 is explained further below with reference to FIG. 3(*b*).

The piston 45 is guided to move only in an axial direction. The tubular casing 43 includes a key 62 that is arranged to engage with a keyway 58 provided on the piston 45. The arrangement of the key 62 and the keyway 58 prevents the piston 45 from rotating (due to reactive torque from the toggle member 49).

Referring to FIG. 3(*b*), the operation of the first indexing module 19 is illustrated as fluid pressure is applied through the first inlet port 27 via the first control line 23 (indicated by solid arrow 57). The darker shaded areas in FIGS. 3(*b*) and 3(*c*) represent fluid in the system as applied via the first control line 23.

Fluid pressure acts on the piston 45, which causes the piston 45 to move axially downwards as illustrated by the arrow 100. The axial movement of the piston 45 also causes axial translation of the key 54. The arrangement of the key 54 and the slot 56 means that the axial translation of the key 54 is converted into angular rotation of the toggle member 49 because the key 54 is guided along the path defined by the slots 56. In the embodiment illustrated in FIGS. 3(*a*) to 3(*d*), each time fluid pressure is applied via the operational control line, the angular rotation of the toggle member 49 as represented by arrow 53 is equivalent to a half turn. The toggle member 49 is capable of full rotation through 360 degrees because of the continuous slot arrangement 56.

Rotation of the toggle member 49 (as illustrated in FIGS. 3(*b*) and 3(*c*)) diverts the flow path of the fluid towards the second outlet 31 as shown by flow path 57 and as illustrated in FIG. 3(*c*). The flow path 57 as illustrated in FIG. 3(*c*) is indicative of fluid exiting the first indexing module 19 via the outlet 31 and then passing to the first flow control device 15 or close the flow control device 15.

When the piston 45 reaches its limit of travel, as illustrated in FIG. 3(*c*), angular flow ports 63 in the toggle member 49 are fully exposed to the fluid flow 57 from the inlet port 27. Therefore, hydraulic fluid flow is substantially unhindered through the central bore 101 of the toggle member 49, through the valve 51 and at exit from the outlet port 31.

Return flow, from the first flow control device 15, is represented by the arrows showing flow path 59. Return flow 59 from the first flow control device 15 passes up through the outlet port 33 of the first indexing module 19 and is returned upstream via the second inlet port 29 and hence the second control line 25. The return flow 59 can be used to provide feedback to indicate correct operation of the flow control device 15.

FIG. 3(*d*) shows the effect of applying fluid pressure to the second inlet port 29 of the first indexing module 19 via the second control line 25, as indicated by flow path 61. The fluid pressure in this case acts on the return side of the piston 45 and against the non-return valve 51 such that the pressure at both outlets 31, 33 on the outlet side of the indexing module 19 is balanced. Therefore, fluid pressure applied through the second control line 25 to the first indexing module 19 has no effect on the status of the first flow control device 15. The first flow control device 15 is operable between fully open and fully closed only when fluid pressure is applied via the first control line 23 through the first indexing module 19.

The indexing modules 19, 21 allow for independent control of each flow control device 15, 17. To operate each flow control device 15, 17 the fluid pressure is applied via the operational control line 23, 25 associated with the flow control device 15, 17 to change the status of the flow control device from fully open to fully closed or from fully closed to fully open.

Referring to FIGS. 3(*a*) to 3(*d*) the flow control devices 15, 17 will maintain the fully open or fully closed position even when fluid pressure is removed or bled off. The indexing modules 19, 21 each comprise a mechanical return spring 47, which on bleeding off pressure, will act on the piston 45 to return it axially to the position illustrated in FIG. 3(*a*). However, the status of the flow control device 15, 17 will remain unaffected until fluid pressure is again applied via the operational control line to cause rotation of the toggle member 49.

FIGS. 3(*a*) to (*d*) equally apply to the operation of the second indexing module 21. The operation and function of the second indexing module 21 is the same as the first indexing module 19, except that fluid pressure is applied via the second control line 25 and return flow is via the first control line 23 and that the second flow control device 17 is controlled by the second indexing module 21.

Figure 4:
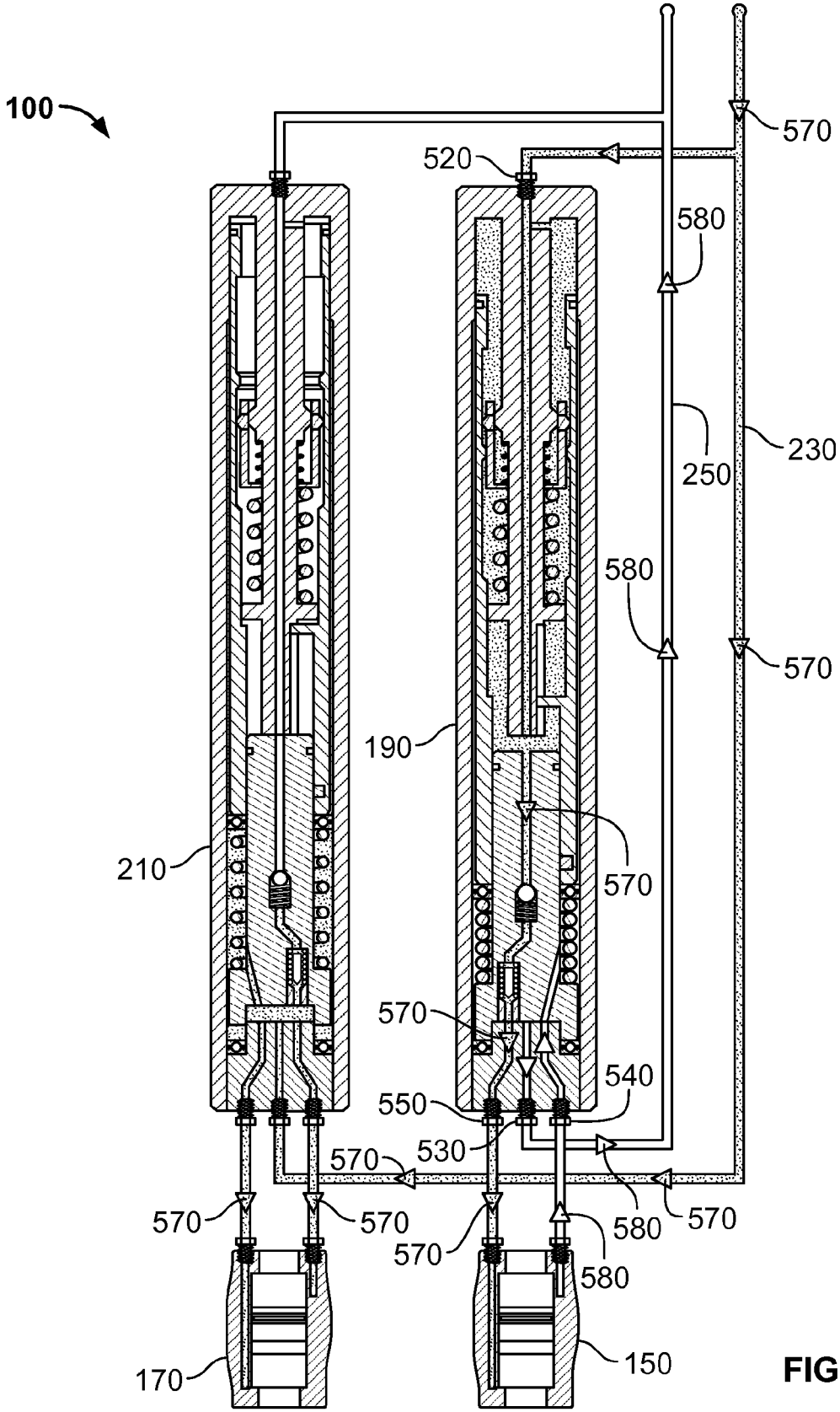
FIG. 4 is a schematic representation of a control apparatus capable of opening and closing a downhole flow control device according to a second embodiment of the present invention.
Figure 5:
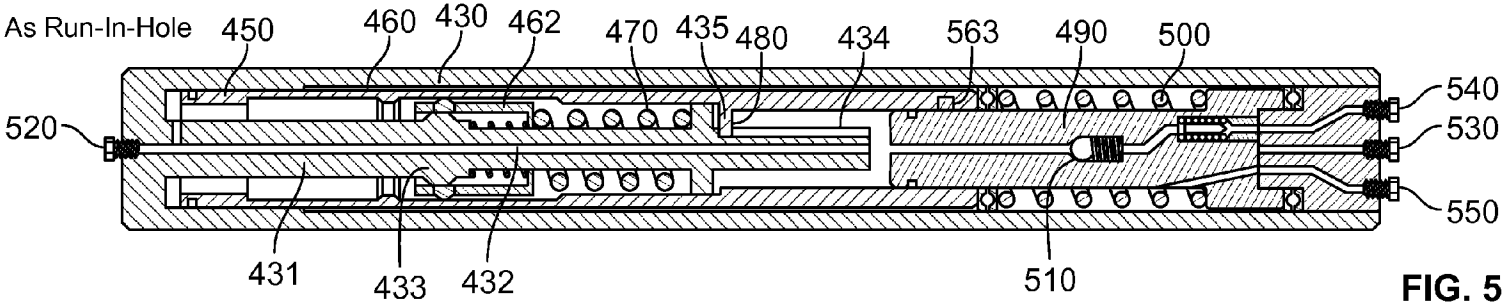
FIG. 5(*a*) is a schematic sectional view of a first indexing module forming part of the control apparatus shown in FIG. 4 and according to a second embodiment of the present invention.
Figure 5B:
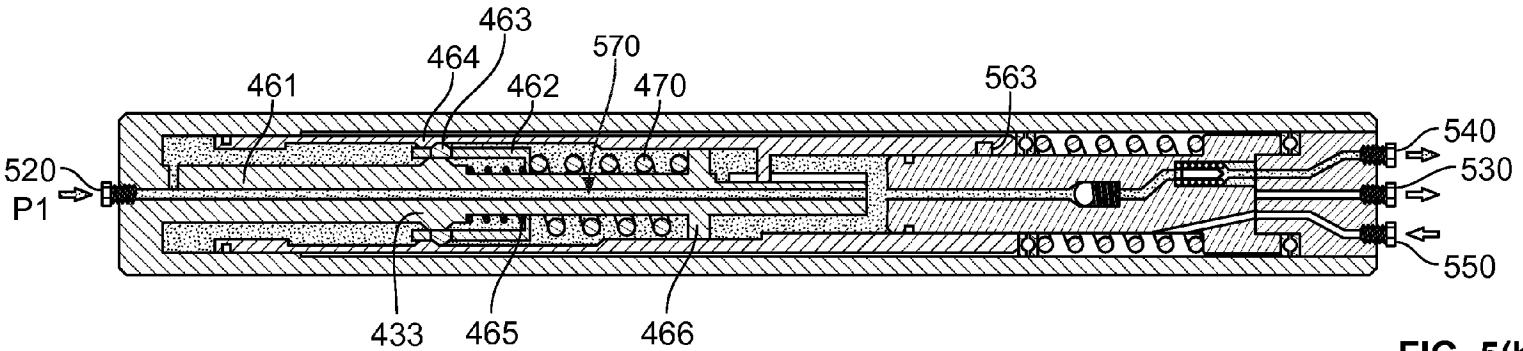
Figure 5C:
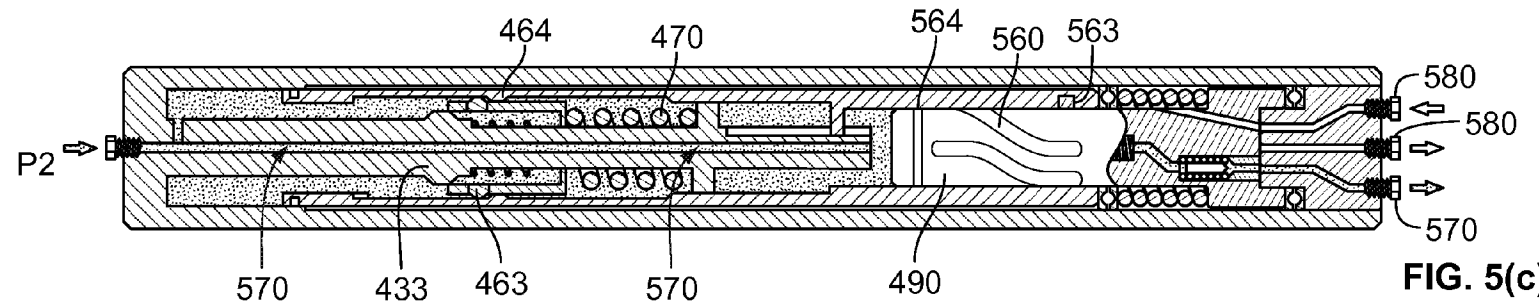
Figure 5D:
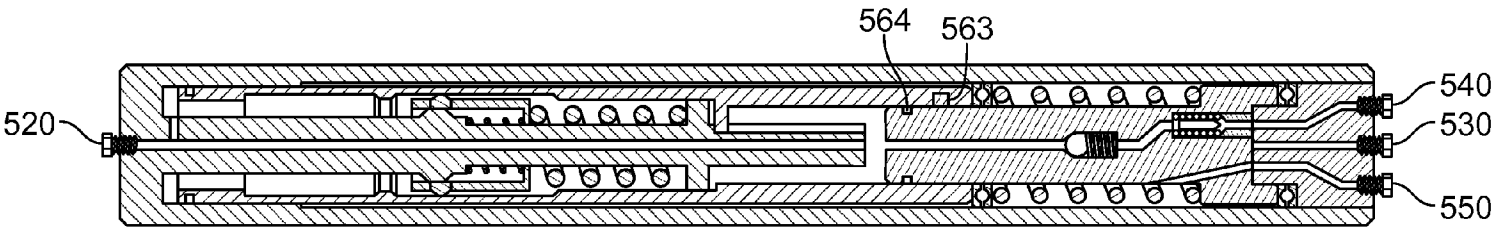
Figure 5E:
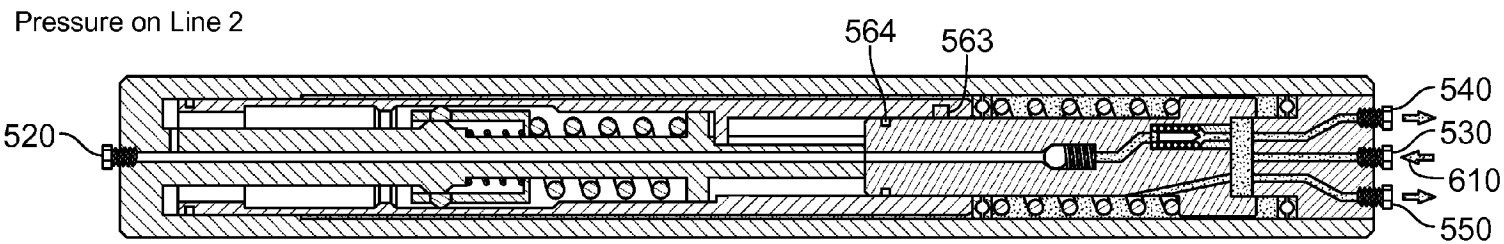
Figure 6:
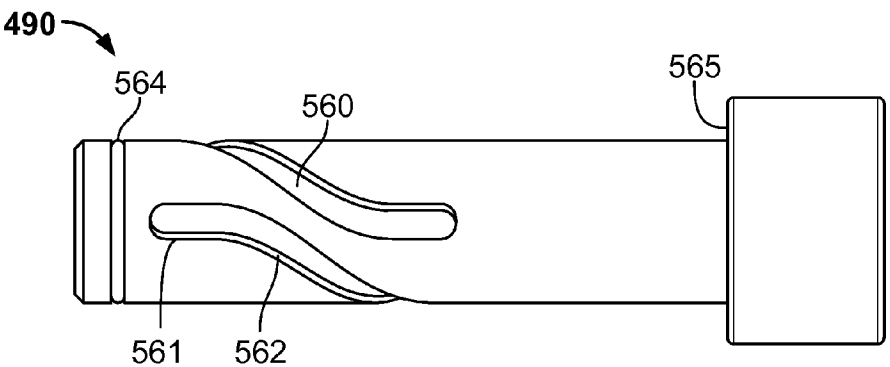
FIG. 6 is a schematic representation of a toggle member for controlling the output direction of fluid from the first indexing module according to the second embodiment of the present invention.

A further embodiment of the invention is illustrated in FIGS. 4, 5(*a*) to 5(*d*) and FIG. 6.

Referring to FIG. 4, there is shown a control apparatus 100 that operates to independently control the opening and closing of two downhole flow control devices 150, 170 using only two control lines 230, 250. As with the first embodiment, the control apparatus 100 comprises two indexing modules 190, 210 that are generally located above the flow control devices 150, 170 in the annulus between the tubular string and the casing of a production well bore.

Two control lines 230, 250, located above or substantially above the indexing modules fluidly connect each of the indexing modules 190, 210 with an associated flow control device 150, 170. A first control line 230 is operable to apply fluid pressure, via the first indexing module 190, to open and close the first control device 150 and a second control line 250 is operable to apply fluid pressure, via the second indexing module 210, to open and close the second flow control device 170.

In the example illustrated in FIG. 4, fluid pressure is being applied to the system via the first control line 230. The flow path through the device is indicated by the darker shaded region and arrows 570 to show the direction of flow at entry to the indexing module 190, through the indexing module 190, at the exit 550 from the indexing module and at the inlet to the first flow control device 150. In the example illustrated fluid pressure is applied within a predetermined range in order to open the flow control device 150. In this example, the pressure range appropriate for opening the flow control device is in the region of about 205 to 345 bar (about 3000 to 5000 psi). Operation of the indexing modules 190, 210 will be described in more detail below with reference to FIGS. 5(*a*) to 5(*e*) and FIG. 6.

In the example illustrated in FIG. 4, the second control line 250 acts as a return line as indicated by the arrows 580. Fluid pressure acting on the second indexing module 210 from the first control line 230 is hydrostatically balanced and hence the status of the second flow control device 170 is not affected by fluid pressure applied through the first control line 230.

The return line provided by the second control line 250 may be adapted to provide feedback indicating activation of the first flow control device 150. Similarly, when activating the second flow control device 170 via fluid pressure from the second control line 250 the return line is provided by the first control line 230, which may also be adapted to provide feedback indicating activation of the second flow control device 170.

FIGS. 5(*a*) to 5(*e*) illustrate the first indexing module 190 at various stages of operation.

FIG. 5(*a*) illustrates the first indexing module 190 and represents its status as it is run into the well bore. FIG. 5(*a*) is also representative of the status of the second indexing module 210 when run into the well bore.

FIG. 5(*b*) illustrates the first indexing module 190 and its status when fluid pressure is applied via the first control line 230 at a level sufficient to close the first flow control device 150. FIG. 5(*b*) also shows the flow path 570 through the first indexing module 190 when fluid pressure is applied via the first control line 230 at a level sufficient to close the first flow control device 150. FIG. 5(*b*) is also representative of the status of the second indexing module 210 when fluid pressure is applied via the second control line 250 at a level sufficient to close the second flow control device 170.

FIG. 5(*c*) illustrates the first indexing module 190 and its status when fluid pressure is applied through the first control line 230 at a level sufficient to open the first flow control device 150. FIG. 5(*c*) also shows the flow path 570 through the first indexing module 190 when fluid pressure is applied through the first control line 230 at a level sufficient to open the first flow control device 150. FIG. 5(*c*) is also representative of the status of the second indexing module 210 when fluid pressure is applied via the second control line 250 at a level sufficient to open the second flow control device 170.

FIG. 5(*d*) illustrates the first indexing module 190 and its status when no pressure is applied (as in FIG. 5(*a*)) or when pressure is bled off. FIG. 5(*d*) is also representative of the status of the second indexing module 210 when no pressure is applied (as in FIG. 5(*a*)) or when pressure is bled off.

FIG. 5(*e*) illustrates the status of the first indexing module 190 when fluid pressure is applied to the control apparatus via the second control line 250. FIG. 5(*e*) is also representative of the status of the second indexing module 210 when fluid pressure is applied to the control apparatus via the first control line 230.

Referring to FIG. 5(*a*), the indexing module 190 comprises a tubular casing 430. Within the tubular casing 430 there is housed an actuating piston 450, a latch mechanism 460, a first holding spring 470, a limiter 480 to limit axial translation of the actuating piston 450, a switching or toggle member 490, a second holding spring 500 and a unidirectional flow valve 510.

As with the first embodiment, the unidirectional valve 510 is represented in FIGS. 5(*a*) to 5(*e*) by a ball and spring arrangement (ball check valve) as an example of a suitable unidirectional valve and to illustrate how the flow path through the valve 510 is limited to flow in one direction only. The unidirectional valve 510 operates to allow flow in the direction towards the outlet only. It will be appreciated that any suitable non-return or unidirectional valve may be used.

As with the first embodiment, the first indexing module 190 comprises a first inlet port 520, a second inlet port 530, a first outlet port 540 and a second outlet port 550. The first inlet port 520 is in fluid communication with the first control line 230 and the second inlet port 530 is in fluid communication with the second control line 250. Two outlet ports 540, 550 are arranged in fluid communication with the first flow control device 150 such that when fluid pressure is applied via the first control line 230 and directed to a first outlet 540 the flow control device 150 moves to the closed position. The second outlet port 550 is arranged in fluid communication with the first flow control device 150 such that when fluid pressure is applied via the first control line 230 and directed to outlet 550 the flow control device 150 returns to the open position.

The tubular casing 430 includes a central stem portion 431 that includes a thru bore 432, an increased diameter (bulging) portion 433 approximately mid length and a key slot 434 at the lower end of the stem 431. The key slot 434 forms part of the limiter 480 to prevent rotation of the actuating piston 450 within the tubular casing 430. The limiter 480 also includes a key 435 as part of the actuating piston 450. The key 435 is guided in the key slot 434 to prevent rotation of the actuating piston 450 within the tubular casing 430 and to limit movement of the actuating piston 450 to axial translation only.

The latch mechanism 460, generally known as a collet latch, together with the first holding spring 470 is arranged to limit the distance travelled by the actuating piston 450 when fluid pressure is applied within a first predetermined range. This is illustrated and discussed further below with reference to FIG. 5(*b*). The latch mechanism 460 includes a sleeve 462 that moves telescopically relative to the stem 431. The sleeve 462 includes an upper stop 463 that may be in the form of flexible fingers or keys that act against a stop 464 on the actuating piston 450. The radial position of the stop 463 is held in position by the bulging portion 433 of the stem 431. The stops 463, 464 act together to limit axial translation of the actuating piston 450 when the fluid pressure applied via the first control line 230 is below or within the predetermined range. In the illustrated example fluid pressure is applied in the range of about 69 to 172 bar (about 1000 to 2500 PSI).

As shown in FIG. 5(*b*), when the fluid pressure is applied via the first control line 230 (or the operational control line) within the predetermined range P1 the latch mechanism 460 limits the travel of the actuating piston 450 to the position where the stop 464 on the actuating piston 450 abuts the upper stop 463 on the sleeve 462.

The sleeve 462 includes a lower stop 465 and the stem 431 includes a lower stop 466 between which is arranged the first holding spring 470, which acts to bias the sleeve 462 to the position where the upper stop 463 is in contact with the bulging portion 433 of the stem 431.

Referring to FIG. 5(*c*), when the fluid pressure P2 applied via the first control line 230 is greater than a predetermined value the fluid pressure exceeds the spring force of the first holding spring 470. The stop 464 acts against the stop 463 on the latch mechanism to push it below the bulging portion 433 on the stem 431 such that the stop 463 flexes inward and allows the stop 464 to move down (to the right as viewed in FIG. 5(*c*)) and allows the actuating piston 450 to travel further axially within the tubular casing 430. In this example, the pressure range appropriate to open the flow control device is in the region of about 205 to 345 bar (about 3000 to 5000 psi).

FIG. 5(*c*) also illustrates the flow direction of fluid as fluid pressure is applied via the first control line 230. The action of the actuating piston 450 causes a key 563 to travel axially with the actuating piston 450. The key 563 engages with a slot 560 in the toggle member 490 as illustrated in FIG. 6. In FIG. 5(*c*) the axial movement of the actuating piston 450, causes rotation of the toggle member 490 such that the flow path is diverted from port 540 to align with and exit from the outlet port 550 such that the first flow control device 150 is opened.

Referring to FIG. 6, there is shown an example of the toggle member 490 of the second embodiment. As with the first embodiment, the toggle member 490 is operable to control the direction of flow from the indexing module 190 to the first indexing module 150. In the second embodiment, the toggle member 490 includes one or more slots 560. The slots 560 each include an axial portion 561 and an angular portion 562. The slots 560 are independent of each other and are arranged to engage with a key or keys 563 (see FIGS. 5(*a*) to 5(*e*)) arranged to connect the toggle member 490 and the actuating piston 450. The toggle member 490 also includes a seal 564 at one end to prevent fluid ingress between the toggle member 490 and the actuating piston and a shoulder 565 at the opposite end to provide a seat for a return spring 500. In this embodiment, the movement of the toggle member 490 is a twist and return action.

Referring to FIG. 5(*b*), when fluid pressure is applied to the system in the first predetermined range (about 69 to 172 bar (about 1000 to 2500 PSI)) to close the first flow control device 150 the key 563 travels axially with the piston 450 and engages with the axial part of the slot 561 of the toggle member 560 (see FIG. 6) so that the toggle member 560 does not rotate and the flow path through the indexing module 190 remains unchanged from the run in state as shown in FIG. 5(*a*).

When the fluid pressure applied increases to the second predetermined range (about 205 to 345 bar (about 3000 to 5000 psi)) to open the flow control device 150 the axial movement of the actuating piston 450 causes the key 563 to move axially also, at which time the key 563 engages with the angular part 562 of slot 560 on the toggle member 490 (see FIG. 6) and causes the toggle member 490 to rotate and therefore shifts the flow path from alignment with first outlet port 540 to align with the second outlet port 550.

FIG. 5(*d*) shows the effect of removing applied fluid pressure from the system and shows that the mechanical action of the holding springs causes the indexing module 190 to reset itself to the condition it was in when first run into the well bore as illustrated in FIG. 5(*a*). The status of the flow control device 150, 170 will remain unaffected until fluid pressure is again applied via the operational control line 230, 250.

FIG. 5(*e*) shows the effect of applying fluid pressure to the second inlet port 530 of the first indexing module 190 via the second control line 250, as indicated by flow path 610. In this situation, the fluid pressure acts on the return side of the piston 450 and against the non-return valve 510 such that the pressure at both outlets 540, 550 on the outlet side of the indexing module 190 is balanced. Therefore, fluid pressure applied through the second control line 250 to the first indexing module 190 has no effect on the status of the first flow control device 190. The first flow control device 190 is operable between fully open and fully closed only when fluid pressure is applied via the first control line 230 through the first indexing module 190.

FIGS. 5(*a*) to 5(*e*) also relate to the operation of the second flow control device 170 and the operation of the second indexing module 210. The operation and function of the second indexing module 210 is the same as the first indexing module 190, except that fluid pressure is applied via the second control line 250 and return flow is via the first control line 230 and that the second flow control device 170 is controlled by the second indexing module 210.

As with the first embodiment, generally the flow control devices 150, 170 are run into the well bore in the open position. Therefore, the first operation of either indexing module 190, 210 is to close the associated flow control device 150, 170.

Whilst specific embodiments of the present invention have been described above, it will be appreciated that departures from the described embodiments may still fall within the scope of the present invention. Moreover, any suitable type of switching or toggle member may be used which activates and deactivates the control mechanism.

The invention claimed is:

1. A control apparatus for a downhole flow control device, the apparatus being operable to control opening and closing of a downhole flow control device:

the apparatus comprising first and second modules, wherein each module is operable to fluidly connect with a respective downhole control device:

each module comprises two inlet ports and two outlet ports;

wherein one inlet port of each module is adapted to fluidly communicate with a first control line located above and the other inlet port of each module is adapted to fluidly communicate with a second control line located above;

the first module being operable to open and close a first downhole control device on application of fluid pressure through the first control line; and the second module being operable to open and close a second downhole control device on application of fluid pressure through the second control line;

wherein each module comprises a switching member defining a fluid flow path and under application of fluid pressure from one of the first or second control line the switching member is operable to direct fluid pressure to one of the two outlet ports to activate opening one of the first or second downhole flow control device, and under application of fluid pressure from the one of the first or second control line the switching member is operable to direct fluid pressure to the other of the two outlet ports to activate closing the one of the first or second downhole flow control device.

2. The control apparatus according to claim 1, wherein the first and second modules are capable of independently and remotely activating the first and second downhole flow control devices.

3. The control apparatus according to claim 1, wherein remote activation means are used to remotely activate the two downhole flow control devices.

4. The control apparatus according to claim 1, wherein, in use, the first control line provides an operational control line operable to remotely activate the first downhole flow control device and the second control line provides an operational control line operable to remotely activate the second downhole flow control device and wherein the first and second control lines provide first and second return lines for the second downhole flow control device and the first downhole flow control device, respectively.

5. The control apparatus according to claim 4, wherein the first return line provided by the first control line is adapted to provide feedback indicating activation of the second downhole flow control device and/or the second return line provided by the second control line is adapted to provide feedback indicating activation of the first downhole flow control device.

6. The control apparatus according to claim 4, wherein each module comprises a piston member adapted to translate axially in one direction under application of fluid pressure from the operational control line and wherein the piston member is biased to translate axially in an opposite direction on removal of the application of fluid pressure.

7. The control apparatus according to claim 4, wherein the switching member is adapted to rotate, turn or twist under application of fluid pressure to the fluid flow path from the operational control line.

8. The control apparatus according to claim 7, wherein each increment diverts a flow path through the switching member to one of the two outlet ports.

9. The control apparatus according to claim 7, wherein rotation in one direction diverts a flow path through the switching member to one outlet port and rotation in the opposite direction diverts the flow path to the other outlet port.

10. The control apparatus according to claim 7, wherein applied fluid pressure within a predetermined range is operable to activate rotation of the switching member, and the predetermined range is determined based on an opening pressure of the downhole flow control device.

11. The control apparatus according to claim 4, wherein each module comprises a unidirectional flow valve capable of being adapted to be in fluid communication with the fluid flow path in fluid communication with the operational control line.

12. The control apparatus according to claim 4, wherein the switching member is adapted to rotate at least a portion of a full rotation.

13. The control apparatus according to claim 12, wherein at least a portion of a full rotation comprises:

a full rotation;

one or more increments of a full rotation;

a full rotation in half turn increments; or a first rotation in one direction and a second rotation in an opposite direction about its axis.

14. The control apparatus according claim 1, wherein the switching member comprises one or more guiding slots.

15. The control apparatus according to claim 14, wherein an engaging member adapted as part of a piston member is adapted to engage with the one or more guiding slots.

16. The control apparatus according to claim 15, wherein the one or more guiding slots comprise at least an axial section and an angular section.

17. The control apparatus according to claim 15, wherein the one or more guiding slots comprise at least an angular section.

18. The control apparatus according to claim 17, wherein the switching member is operable to rotate when, in use, the engaging member follows a path defined by the angular section of the one or more guiding slots.

19. The control apparatus according claim 1 further comprising a unidirectional valve in fluid communication with the fluid flow path and/or comprising a closed loop hydraulic circuit.

20. The control apparatus according claim 1, wherein activation to open and close the first downhole flow control device is independent of activation to open and close the second downhole flow control device.

21. The control apparatus according to claim 1, wherein the apparatus comprises: a first indexing module comprising a first and second inlet port, and a first and second outlet port; the first inlet port being in fluid communication with a first control line and the second inlet port being in fluid communication with a second control line; the outlet ports being in fluid communication with their respective flow control device such that when fluid pressure is applied via the respective control line and directed to the respective outlet port of the outlet ports then the respective flow control device is capable of moving to a first open or closed position.

22. The control apparatus according to claim 1, wherein the first and second modules are adapted for connection to the first and second control lines above the first and second downhole flow control devices.

23. The control apparatus according to claim 1, wherein activation of each downhole flow control device is capable of being controlled by a flow path through each of the modules, and wherein the flow path is capable of being defined by the switching member.

24. A method of opening and closing a downhole flow control device using a control apparatus, the method comprising:

providing an apparatus comprising first and second modules, wherein each module is operable to fluidly connect with a respective downhole control device:

each module comprises two inlet ports and two outlet ports;

wherein one inlet port of each module is adapted to fluidly communicate with a first control line located above and the other inlet port of each module is adapted to fluidly communicate with a second control line located above;

the first module being operable to open and close a first downhole flow control device on application of fluid pressure through the first control line; and the second module being operable to open and close a second downhole flow control device on application of fluid pressure through the second control line;

wherein each module comprises a switching member defining a fluid flow path and under application of fluid pressure from one of the first or second control line the switching member is operable to direct fluid pressure to one of the two outlet ports to activate opening one of the first or second downhole flow control device, and under application of fluid pressure from the one of the first or second control line the switching member is operable to direct fluid pressure to the other of the two outlet ports to activate closing the one of the first or second downhole flow control device.

25. The method of opening and closing a downhole flow control device according to claim 18, wherein the first module comprises first and second inlet ports and first and second outlet ports, the first and second outlet ports being in fluid communication with the first downhole flow control device such that the switching member of the first module is operable to direct fluid pressure from the first control line via the first inlet port to the first outlet port to activate the first downhole flow control device to a first open position and to the second outlet port to activate the first downhole flow control device to a first closed position, the second module comprises third and fourth inlet ports and third and fourth outlet ports, the third and fourth outlet ports being in fluid communication with the second downhole flow control device such that the switching member of the second module is operable to direct fluid pressure from the second control line via the third inlet port to the third outlet port to activate the second downhole flow control device to a second open position and to the fourth outlet port to activate the second downhole hole control device to a second closed position, and the first inlet port and the fourth inlet port are adapted to fluidly communication the first control line, and the second inlet port and the third inlet port are adapted to fluidly communication the second control line.

* * * * *

UNITED STATES PATENT AND TRADEMARK OFFICE

CERTIFICATE OF CORRECTION

PATENT NO. : 8,602,112 B2
APPLICATION NO. : 13/296741
DATED : December 10, 2013
INVENTOR(S) : Michael Adam Reid It is certified that error appears in the above-identified patent and that said Letters Patent is hereby corrected as shown below:

On the Title Page, item (30) please insert -- Foreign Application Priority Data, GB 1019745.5, filed on 11/22/2010 --

In the Claims, Column 16, Line 14, after "downhole", please delete "hole"

Signed and Sealed this
Thirteenth Day of May, 2014

Michelle K. Lee

Michelle K. Lee
*Deputy Director of the United States Patent and Trademark Office*